US006167595B1

(12) United States Patent
Prandini et al.

(10) Patent No.: US 6,167,595 B1
(45) Date of Patent: Jan. 2, 2001

(54) METHOD AND DEVICE FOR AUTOMATICALLY REPLACING THE LAP, PREPARING AND JOINING ITS EDGES AND RESTARTING IT IN A COMBING MACHINE

(75) Inventors: Girolamo Prandini; Giovanni Battista Pasini, both of Palazzolo Sull'Oglio (IT)

(73) Assignee: Marzoli S.p.A., Palazzola Sull'Oglio (IT)

( * ) Notice: Under 35 U.S.C. 154(b), the term of this patent shall be extended for 0 days.

(21) Appl. No.: 09/478,403

(22) Filed: Jan. 6, 2000

(30) Foreign Application Priority Data

Jan. 14, 1999 (IT) ..... MI99A0054

(51) Int. Cl.[7] ..... D01G 19/00
(52) U.S. Cl. ..... 19/115 R; 19/215; 19/225
(58) Field of Search ..... 19/25, 26, 65 A, 19/115 A, 115 R, 215, 225, 229; 57/281

(56) References Cited

U.S. PATENT DOCUMENTS

| | | | | |
|---|---|---|---|---|
| 5,027,475 | * | 7/1991 | Mondini et al. | 19/115 R |
| 5,038,441 | * | 8/1991 | Mondini et al. | 19/115 R |
| 5,077,865 | * | 1/1992 | Mondini et al. | 19/115 R |
| 5,303,453 | * | 4/1994 | Langel et al. | 19/115 R |
| 5,430,917 | * | 7/1995 | Inagaki et al. | 19/115 R |
| 5,778,493 | * | 7/1998 | Moretti et al. | 19/115 R |

* cited by examiner

*Primary Examiner*—Danny Worrell
*Assistant Examiner*—Gary L. Welch
(74) *Attorney, Agent, or Firm*—Oblon, Spivak, McClelland, Maier & Neustadt, P.C.

(57) ABSTRACT

A method and device substitutes, prepares and joins laps in a combing machine, in which the preparation of an edge of a new lap package is made by holding fast the package in an unwinding position, while handling its clamped and crimped edge in a tearing manner.

9 Claims, 4 Drawing Sheets b
a 1
2
2
3
4
5
26
F
49
20
21
22
23
30

METHOD AND DEVICE FOR AUTOMATICALLY REPLACING THE LAP, PREPARING AND JOINING ITS EDGES AND RESTARTING IT IN A COMBING MACHINE

BACKGROUND OF THE INVENTION

1. Field of the Invention

This invention refers to a method of combing textile fibers, in which the fibers of a thin layer blanket, known in this instance as a lap, wound up in a roller-type package obtained by joining and pressing several fiber slivers originating from carding, are processed in an intermittent and synchronous fashion by a series of organs, advancing rollers, clamping devices, circular and straight-line combs and so on, which work together in picking up the lap fibers in tufts and shaping another enhanced type, marked by more parallel fibers and a lesser content-of short fibers, of "neps" and micro-impurities. More details on combing machines are given in European Patent No. 573,121.

2. Description of the Related Art

In the most modern machines, the combing occurs at a rate of 250 to 400 beats per minute and consists in selectively transferring edges of long fibers, picked up, combed and laid out by the feed lap to the new lap representing the enhanced product, separating the short fibers, destined for articles of lesser quality.

In general the combing machines are constituted of several combing "heads", in the order of ten heads per machine. The laps produced by the machine's combing stations turn out to be formed by combed fibers of a cleaner, more even and stronger type. The combing machines' combing heads are generally equipped with common driving devices and controls, which are jointly started and arrested. This typically occurs when the feed lap runs out and needs to be replaced with a new package. These packages are in the shape of a roll of a width of about 300 mm and a diameter of about 500 mm, in which the lap is wound up on a tube forming its core.

When the feed in one of the stations or combing heads runs out, the general practice is to stop, replace and prepare all the feed laps in all the stations, even if the laps are still not depleted in some of them, and to restart the combing machine.

This operation consists in removing the tubes of the laps while perhaps advancing the laps, in replacing them with new laps and in preparing the first edge of the new lap packages, so as to make it possible to join them to the tail edge of the previous laps, and realign them with the organs of the combing station.

Italian Patent No. 1,276,945 in the name of the describes and claims a device and an automatic lap replacing method capable of essentially eliminating any manual action during the lap replacing operations. However, this replacing system provides for holding fast a new lap package in an upstream "stand-by" position with respect to the lap being processed, while already preparing the joining edge.

This prearranging and preparing of the joining edge is done by the operator who positions the package, identifies the end of the lap and inserts it in a suction-type preparing device. During the transfer of the package and preparation of the edge, the prearranged lap package comes into both a rolling and sliding contact with fixed parts of the combing machine. In the overall replacing method, the outer surface of the package and the ready-to join edge may be damaged or at least disarranged, thus rendering the device less efficient and at any rate demanding not only a surveillance but also a manual operator intervention in the method. Before starting the machine, all the packages require a check-up of the operation's successful conclusion and an eventual intervention, in addition to a stand-by prearranging and preparing action for the new lap packages, with the resulting increase in down time periods and processing costs.

SUMMARY OF THE INVENTION

In particular, the object of this invention is the previously mentioned operation of replacing the feed laps in a combing machine, and refers to a device and a method capable of achieving, without any manual operator intervention, even the stand-by prearranging and edge preparing stages in the method of replacing the laps in a combing machine.

This invention refers to a new system for replacing the laps, and consists in a device and a method. The method is in its essential features defined by its preferential embodiments. The device is defined in its features by its essential embodiments.

In order to better describe the characteristics and advantages of this invention, the same will be described in relation to a typical embodiment, illustrated for exemplifying but nonlimiting purposes in the simplified drawings shown in FIGS. 1 to 4.

BRIEF DESCRIPTION OF THE DRAWINGS

FIG. 2A illustrates the overall system of replacing the laps and preparing the joining edge, while FIG. 2B shows an enlarged detail of the laps' junction.

DETAILED DESCRIPTION OF THE INVENTION

Figure 1:
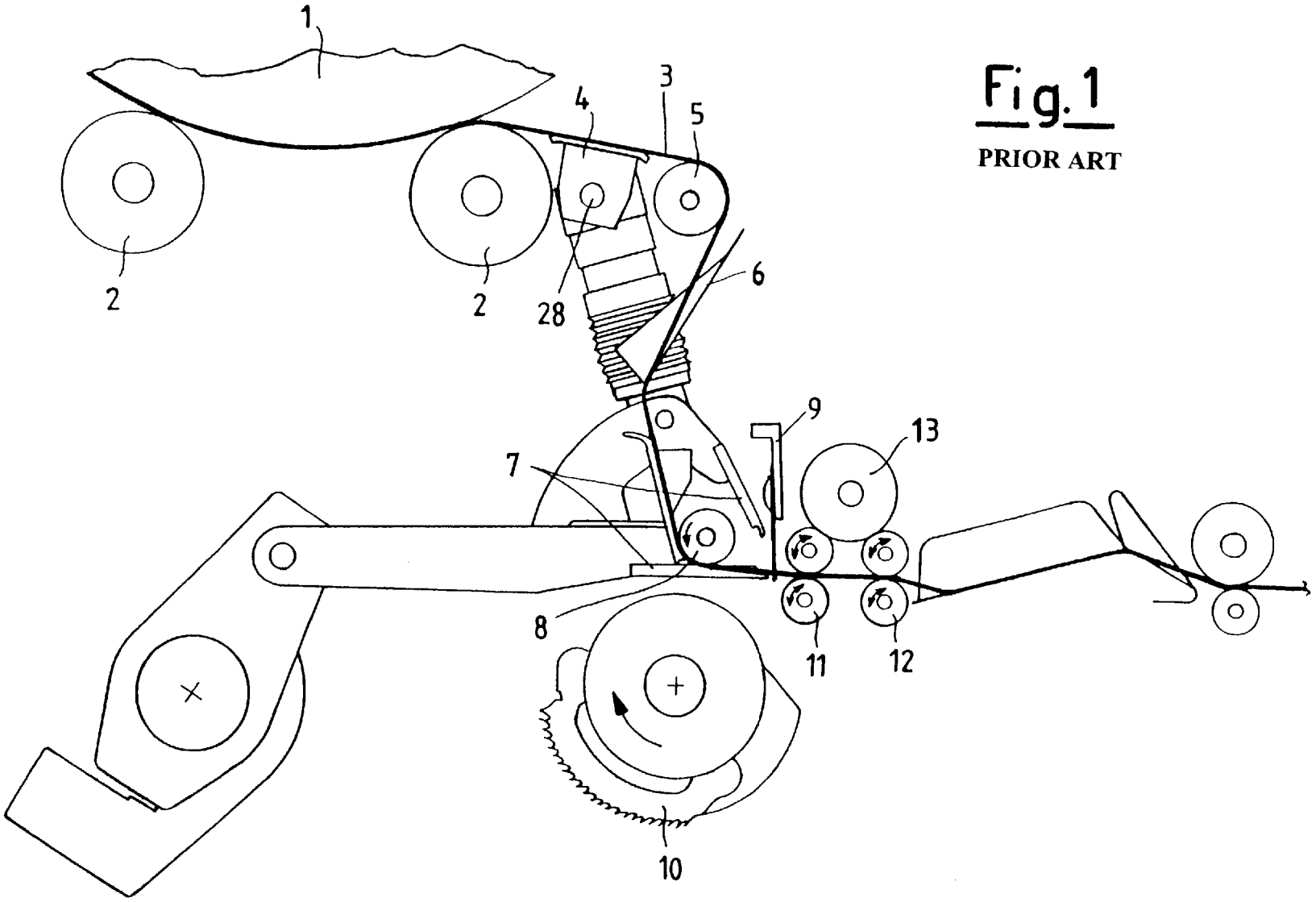
Fig. 1 PRIOR ART
FIG. 1 outlines the functioning of the prior art combing machine during its normal operation.

FIG. 1 shows the main combing organs and their normal operation during the combing phase. This operation is basically as already described in the Italian Patent No. 1,276,945. A lap 1 in an unwinding phase is resting on unwinding rollers 2, which impart a counterclockwise rotation to the unwinding motion of the lap 1. An unwound edge 3 is first passed over the upper face of an edge joining organ 4, which remains essentially inoperative during a normal method while acting as a simple rest, and is carried downstream by a motorized pulling roller 5. The unwound edge 3 is guided by an adjustable guide device 6 and recalled by a feeding cylinder 8, and enters the actual combing phase.

This treatment is run by the following organs:

an alternating motion clamp 7, a lap feeding cylinder 8, a straight-moving comb 9, a rotating comb 10 with a fitted circular segment, and tearing cylinders 11, 12 with an alternating clockwise and counterclockwise motion, which pick up the processed edges in time. The cylinders 11, 12 are driven by conventional link systems not shown in the figure for the sake of simplicity. A cleaning counter-roller 13 made of a soft material keeps the surface of the tearing cylinders 11 and 12 clean.

Figures 2A, 2B:
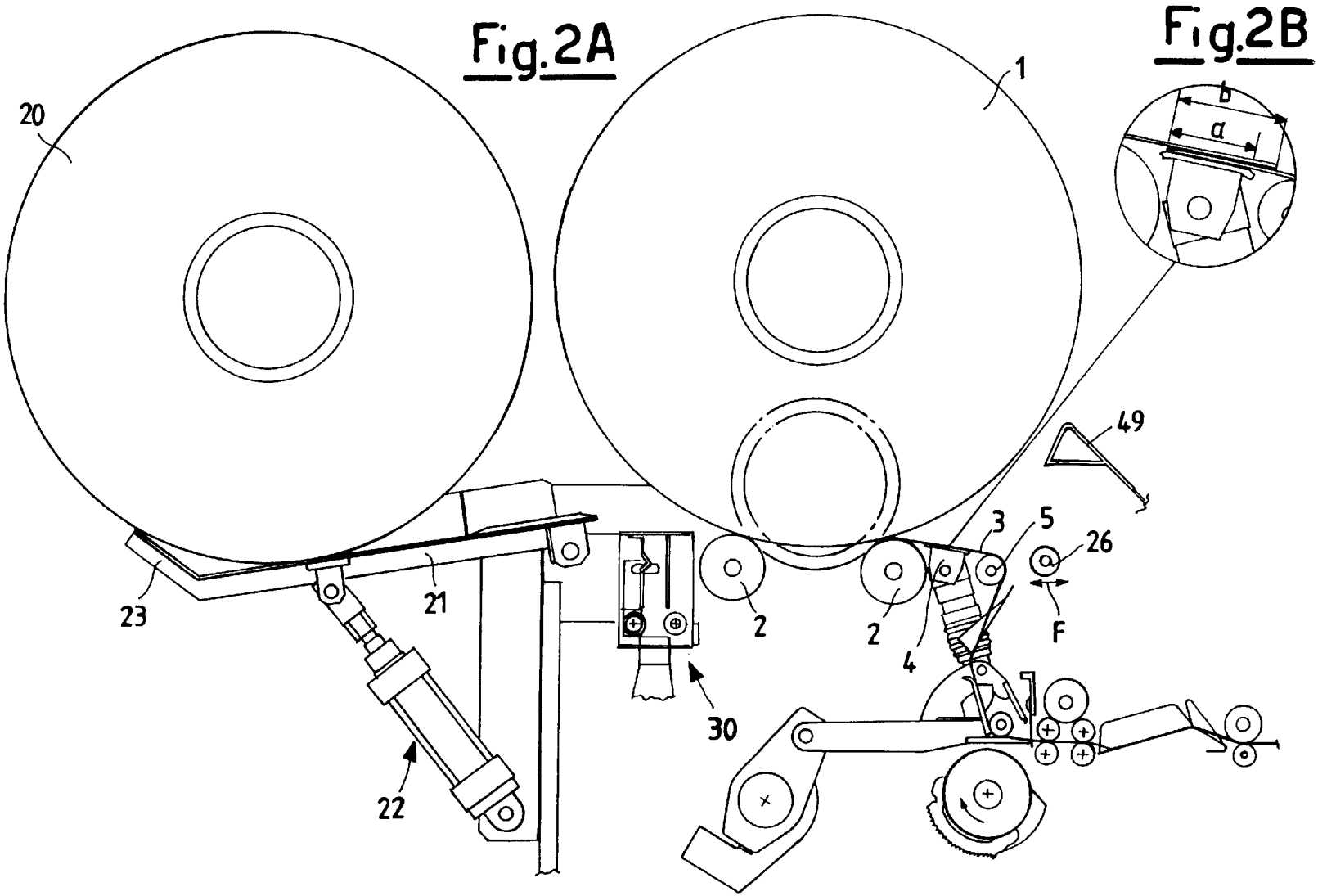

FIG. 2A refers to a device according to this invention to replace and prepare the lap package, showing that the combing method simply positions a lap package 20, destined to replace the lap package 1 being processed. The lap package 1 is shown by a full line in its initial phase, and a dashed and dotted line in its final depleting phase. In accordance with this invention, no preliminary stand-by preparation of the lap package 20 is carried out.

This package 20 is placed on a plane 21 capable of being tilted by a lifter 22, for example a double-acting pneumatic cylinder, between a stand-by position tilted to the left to hold the package 20 in contact with the edge 23, and a delivery position tilted to the right so as to roll the lap edge toward the rollers 2 into an unwinding position.

The moving of the replacing lap packages and the withdrawal of the tubes of the residual or depleted laps may be carried out by mechanized auxiliary devices, for example according to European Patent No. 312,503.

The unwinding operation-of the lap 1 resting on its rollers 2 continues to its conclusion at a constant linear speed. The progressive depletion of the lap package 1 is controlled by the machine's control unit in an already known manner.

As soon as the programmed limit of length in meters is reached in one of the machine's combing stations, the machine is stopped. The tearing of the depleted lap is then carried out.

For this operation, a counter-roller 26 approaches the pulling roller 5, in a mobile manner as shown by an arrow F, so as to block the unwound edge 3 of the lap 1 from being depleted. This terminal portion is in its residual wraps of the lap 1 wound around its tube, while always resting on its unwinding rollers 2.

The unwinding rollers 2 are equipped with a driving mechanism to rotate them both in an unwinding counterclockwise as well as in a rewinding clockwise manner. This driving action may be carried out by piloting their motor with an inverter, or equipping them with a double driving system, one in a clockwise and the other in a counterclockwise direction, connected as an alternative to the rollers 2.

During the tearing operation of the lap 1, the rollers 2 are therefore actuated so as to rewind the edge 3 around its tube. Said edge 3 is held fast by the pair of tightened rollers 5 and 26, and tears at its point of minimum strength, which turns out to be in the vicinity of the downstream roller 2 (shown in FIG. 2A on the right), while holding fast the depleting length of the lap 1 on the joining organ 4.

The resting plane for the joining organ 4 carries small aspirating slots, connected by a conduit 28 in FIG. 1 to the machine's aspirating system, which may exercise a modulated aspirating action. During the lap replacing phases, a moderate edge aspirating action is maintained on the edge at the final end of a length a in FIG. 2B of the depleted lap 1 seen in phantom lines in FIG. 2A.

Once the depleted lap has been torn and the length a of its edge is held fast by its joining organ 4, the depleted lap 1 along with its tube is unloaded with transporting devices in an already known manner, for instance as described in the previously mentioned Italian Patent No. 1,276,945.

The residual lap still wound up on the tube is recovered in the lap preparing station and re-utilized to prepare the new packages.

The tilting plane 21 is actuated by the lifter 22 to assume a delivery position, by tilting it slightly to the right so as to roll the package 20 toward the rollers 2 in an unwinding position and to rest on the same.

With the new package in an unwinding position, the rollers 2 are made to rotate in a direction counter to that of the unwinding motion, so as to take the lap edge to a preparing station 30. This preparing station 30 is positioned immediately before the unwinding roller 2 in a more upstream position (to the left in FIG. 2A) and is illustrated in the enlarged detail of FIGS. 3A and 3B.

The preparing station 30 comprises a feeding plate 31 fitted with a longitudinal slot 32 depending on the front side of the machine and of the same length as the width of the lap. A pneumatic piston 33 or an equivalent actuator is placed under the slot 32, so as to approach and detach itself with its mobile equipment in a horizontal direction to the fixed countering element 34.

Figure 3B:
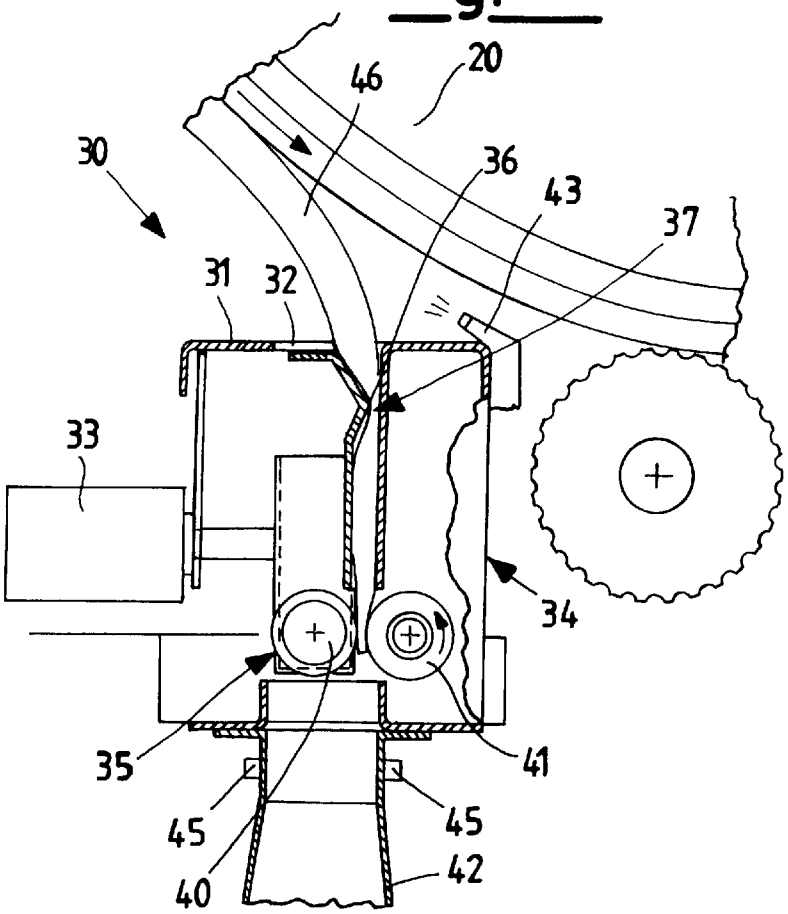
FIGS. 3A and 3B illustrate in particular the clamping and lap edge preparing station.
Figure 3A:
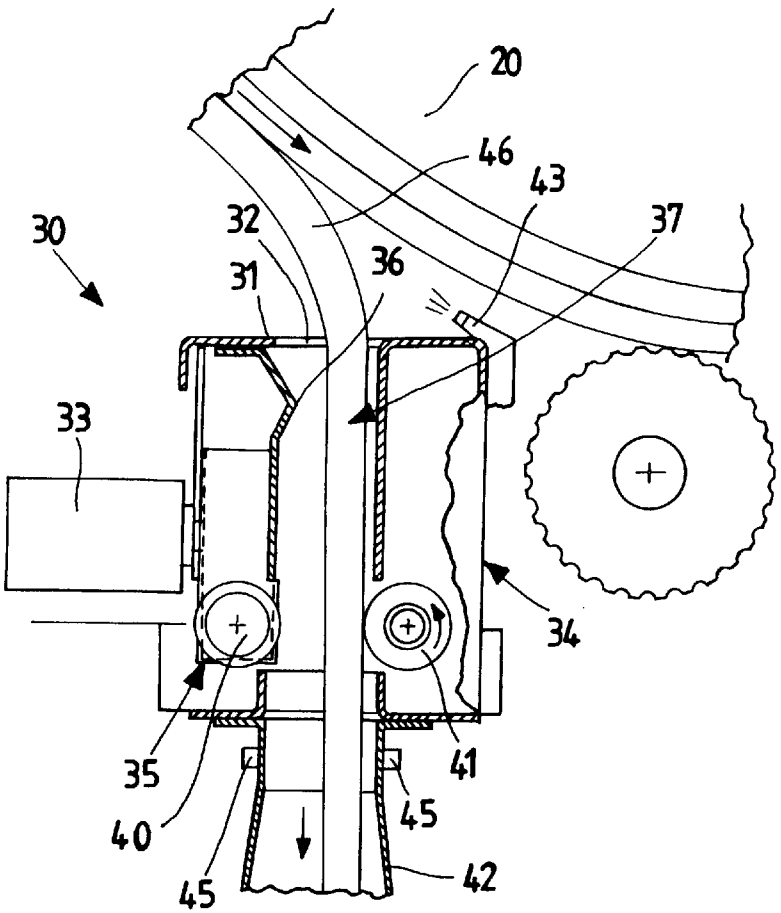

FIG. 3A shows the mobile equipment in an open position, while FIG. 3B shows the mobile equipment in a closed position.

The mobile equipment in FIG. 3A comprises in its upper part a clamping element 35 fitted with a projection 36 so as to shape a clamp 37 against a part of the fixed element 34 placed at its level; in its lower part, the mobile equipment comprises a tearing roller 40 and a free-wheeling tearing unit positioned so as to counter a motorized roller 41 supported by the fixed element 34. These tearing rollers 40, 41 are covered by a material with good adhering properties, for instance hard rubber.

It is alternatively possible to motorize the roller 40 positioned on the mobile element instead of the roller 41 positioned on the fixed element 34.

Under the tearing rollers 40, 41, the preparing station 30 comprises a suction nozzle 42 connected to the common suction system of the machine.

The preparing station 30 is constituted in its upper portion by the clamp 37 and in its lower portion by the tearing rollers 40, 41, which simultaneously lock onto the clamped edge of the lap package 20 by the action of the pneumatic piston 33.

The operation of preparing the edge of the new lap of the lap package 20 unfolds in the following stages.

The operation of clamping the end provides for rotating the lap package 20 in a sense counterclockwise to that of unwinding to bring the edge of the lap package 20 up to the preparing station 30, which is in the configuration of FIG. 3A shown with the clamp 37 open and the aspirating suction nozzle 42 actuated at a strong rate. According to the preferred embodiment of the invention, the clamping action of the lap's edge is aided by one or more blowing nozzles 43, set up downstream of the preparing station 30 so as to ease the detaching of the edge from the lap package 20, and offer it to the aspirating action of the slot 32. These nozzles 43 are fed with compressed air, along with the powerful suction from the nozzle 42.

Figure 4:
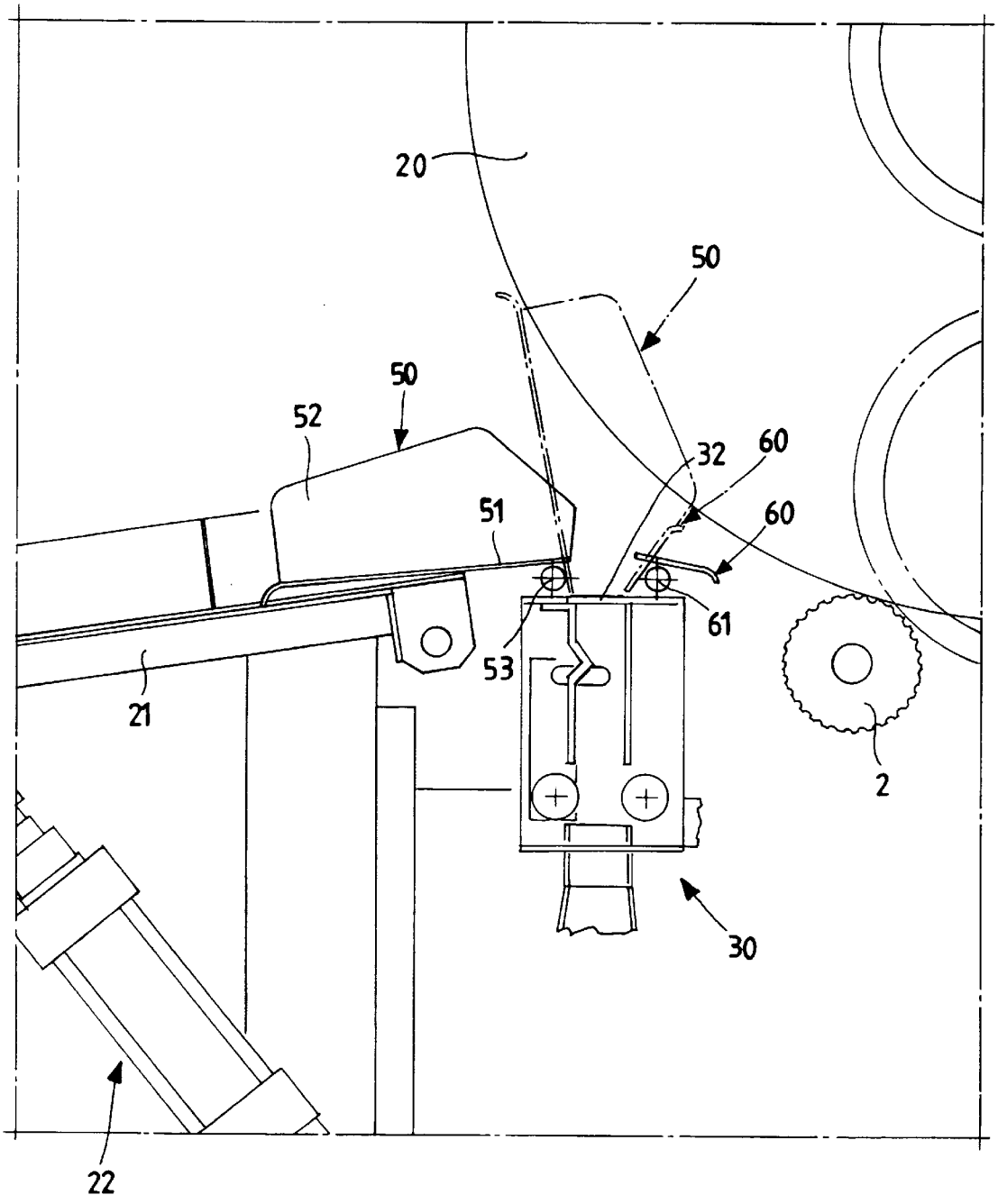
FIG. 4 shows a variant of the embodiment of said clamping and lap edge preparing station.

According to another embodiment of this invention illustrated in FIG. 4, the suction recalling effect of the initial edge of the new lap package 20 by the preparing station 30 is enhanced if the station 30 is fitted with two mobile partitions 50 and 60, which in a lifted position generate a funnel shape turned toward the slot 32 of the preparing station 30.

The upstream partition 50 with a U-shaped profile rests its base 51, in a lowered position shown by a full line, on the surface of the tilting plane 21. The two arms of the U are constituted by flat steel sheets 52 and have a cross-distance so as to contain the two bases of the cylinder of the lap package 20. The partition 50 is hinged in a pin 53 and normally in a freewheeling resting position shown by a full line, where it cannot hinder the lifting motion of the plane 21 nor the resulting rolling of the lap package 20. Only after the rolling of the new lap package 20 on its rollers 2, the partition 50 is lifted to the operating position shown by a dashed and dotted line, by using devices already known in the art, for example a single-acting pneumatic cylinder, not shown in FIG. 4 for the sake of simplicity. The release of fluid from said pneumatic cylinder allows the partition 50 to revert to its resting position by the simple action of gravity.

On the downstream side, on the other hand, there is a partition 60 having an essentially planar surface, as shown by a full line in a resting position. Like the other partition 50, the partition 60 is hinged in a pin 61. During the edge clamping operation, the partition 60 is lifted to its operating position shown by a dashed and dotted line, by using devices already known in the art and similar to those of the partition 50.

With the two partitions 50, 60 raised in the working position shown by a dashed and dotted line, a sort of funnel is formed which generates a stream of greater intensity toward the slot 32 so as to detach the outermost layer of the lap package 20 advancing with a counterclockwise rotation, without causing cuts and with greater precision. This motion achieves a better detachment of the edge, a lower suction head needed for the slot 32 and a better overall performance of the suction device.

In the edge clamping phase from the lap, if its position on the lap package 20 is known, its counterclockwise rotation is fed by the angle which corresponds to that needed to take the edge to the station 30, and to bring it to face the longitudinal slot 32 over a sufficient length. If the angular position of the edge is unknown, its clamping can be done by rotating the new lap package 20 by at least one full turn, thus ensuring that the edge is brought to face the slot 32 to enable it to be clamped by the preparing station 30. Alternatively and according to a preferential embodiment of this invention, the suction nozzle 42 of FIG. 3A if fitted with one or more sensors 45 of the presence of the edge is, placed downstream of the tearing rollers 40, 41, which signal its presence to the control unit downstream of the tearing rollers 40, 41 and therefore the completion of the clamping action. These sensors 45 are of a conventional type, for example of a photocell.

After the clamping has occurred, the package's rotation in a counterclockwise direction is stopped and the edge 's preparation proceeds and the edge preparing station 30 assumes the configuration shown in FIG. 3B. The clamp 37 is locked unto an edge 46, and the two tearing rollers 40, 41, are locked downstream on the edge that continues to move on inside the nozzle 42, which is now aspirated at a moderate rate. The roller 40 is actuated in a rotating manner for a brief period of time, thus also dragging the free-wheeling roller 41 along with it. As a result of the stretching action exerted in the length between the clamp 37 and the tearing rollers 40, 41, the edge 46 is interrupted and frayed between the organs. The downstream suction nozzle 42 removes the length from the lap package 20. The edge of the new package 20 is ready to be joined to the edge of the exhausted lap package 1 shown in FIG. 2A. The completed preparation of the edge may also be signaled by the sensor 45 in FIG. 3B, which first signals the interference of the edge to be prepared, and subsequently the noninterference of the prepared edge.

After the preparation has been completed, the mobile equipment is re-opened according to the configuration of FIG. 3A: the edge 46 of the lap package 20 is released.

The lap package 20 is made to rotate in a clockwise sense and the edge 46 is prepared and freed of the new lap package 20 resting on a bar 49 in FIG. 2A that extends along the front of the combing machine. According to another preferred embodiment of the machine, even the bar 49 is fitted with one or more nozzles or slots connected to the combing machine's aspirating system, so as to hold the initial edge of the new lap fast and prevent it from falling outside the bar 49.

The rollers 2 are then actuated to rewind the edge 46 of the FIG. 3B on the tube, withdrawing it from the bar 49 of FIG. 2A and attracting it to the resting surface of the joining organ 4, where the final edge of the lap 1 is already held fast by the aspirating action. The rotation of the rollers 2 to recall the edge of the new lap package 20 is precision-controlled so as to achieve a superposition predetermined by the two edges of the preceding lap 1 and by the new lap package 20 over their entire width, thus achieving a superposition, on the joining organ 4, of the length b of the new lap package 20 over the length a of the edge 3 of the previous depleted lap 1, as shown in the enlarged detail of FIG. 2B.

With the two superposed edges, the aspirating strength of the joining organ 4 is increased up to its maximum value for a short time, so as to obtain a joining effect for the commingling of the fibers between the two edges, in a manner already known in the art. This junction turns out to be sufficient to establish a continuity between the two laps and to resume the processing, until the joined length is moved to the combs.

The normal combing method is then resumed. The unwinding rollers 2 are normally actuated by unwinding the lap from the new package. The combing station is restarted by holding the counter roller 26 of FIG. 1 still pressed against the pulling roller 5. The pressure of the two rollers at the passing of the joined edges increases their cohesion. The guide device 6 in FIG. 1 conveys the two joined layers to the cylinder 8 for the feeding of edges and allows the joined length to reach the combing organs. The joined length passes the combing organs and joins the product coming from the other combing stations of the machine. The various junctions are practically indistinguishable from the belt produced.

After restarting it, the machine is in the configuration shown in FIG. 1, the roller 26 in FIG. 2A is detached, the unwinding rollers 2 and the other organs operate at their normal working rate, and a new package 20 of a reserve lap is placed on stand-by on the plane 21.

The method and device for replacing and preparing the laps according to this invention presents considerable advantages with respect to those known in the art, and at least the following among them deserve to be mentioned.

The overall replacing system performs the preparation of the package of the lap already in an unwinding phase, so as to avoid any harmful sliding action during the transport. All the motions occur by simple rolling. The preparation of the end portion, as well as the stand-by delivery of the new packages occurs without any manual operator intervention. The need for labor for manual interventions is reduced to mere malfunctions, thus drastically cutting down on their share of the processing costs. As already mentioned above, the product also turns out to be more uniform in the length relating to the junction between the two laps, thus making the junction itself practically unnoticeable.

What is claimed is:

1. A method for replacing a depleted lap and for automatically preparing a new lap at a preparing station of a combing machine, for joining of edges of the two laps, comprising the steps of:

stopping the combing machine while holding fast a length of an edge of the depleted lap, actuating unwinding rollers to rewind the depleted lap in an opposite direction, to rewind the edge of the depleted lap, to tear the edge of the depleted lap in a vicinity of a downstream one of the rollers and to hold fast the edge of the depleted lap on a joining organ by aspiration, unloading the depleted lap, loading the new lap in a position resting on the unwinding rollers and laying an initial edge of the new lap down on a bar, actuating the unwinding rollers to rewind the edge of the new lap and to bring said edge of the new lap up to the joining organ with a superposition of a length of said edge of the new lap over the length of the edge of the depleted lap, joining said edges in the joining organ, and resuming operation of the combing machine, wherein the automatic preparing of the edge of the new lap is performed at the preparing station while the new lap is placed on the unwinding rollers, first by performing a clamping operation in an aspirating slot by rotating the new lap in a counterclockwise direction on the unwinding rollers and holding fast the new lap, then by blocking the edge of the new lap with a clamp, and finally by tearing the edge of the new lap between the clamp and a pair of tearing rollers, and wherein the edge of the new lap is brought up to the joining organ by rotating the new lap in a clockwise direction on the unwinding rollers.

2. A method according to claim 1, wherein clamping of the edge of the new lap is performed by a combined action of the aspirating slot and by at least one blowing nozzle positioned downstream of the preparing station.

3. A method according to claim 1, wherein clamping of the edge of the new lap is performed by a combined action of the aspirating slot and two mobile partitions forming a funnel toward the aspirating slot of the preparing station.

4. A method according to claim 1, wherein clamping of the edge of the new lap is performed by rotating the new lap by at least one full turn, so as to ensure that the edge of the new lap is brought to face the aspirating slot for clamping in the preparing station.

5. A method according to claim 1, wherein clamping of the edge of the new lap is verified by at least one sensor mounted on an aspirating nozzle to reveal a presence of the edge of the new lap placed downstream of the tearing rollers.

6. A method according to claim 1, wherein the preparing station for the edge of the new lap is positioned immediately before one of the unwinding rollers farther upstream.

7. A method according to claim 6, wherein the preparing station is constituted in an upper portion by the clamp and in a lower portion by the tearing rollers simultaneously locking onto a clamped edge of the new lap by action of a pneumatic piston.

8. A method according to claim 6, in which the unwinding rollers are equipped with rotating devices to actuate both winding and unwinding motion, wherein actuation is performed by inverter piloting devices for a motor.

9. A method according to claim 6, wherein the preparing station is equipped with mobile partitions which generate, in a raised position, a funnel-shaped form pointing toward the aspirating slot.

* * * * *

UNITED STATES PATENT AND TRADEMARK OFFICE

CERTIFICATE OF CORRECTION

PATENT NO. : 6,167,595
DATED : January 2, 2001
INVENTOR(S) : Girolamo Prandini, et al.

It is certified that error appears in the above-identified patent and that said Letters Patent is hereby corrected as shown below:

Title Page,
Item (73), the Assignee's city of residence is incorrect. Item (73) should read as follows: (73) Assignee" Marzoli S.p.A., Palazzolo Sull' Oglio (IT)

Signed and Sealed this

Tenth Day of July, 2001

*Attest:*

Nicholas P. Godici

*Attesting Officer*

NICHOLAS P. GODICI
*Acting Director of the United States Patent and Trademark Office*